US008905149B2

(12) United States Patent
Bailey et al.

(10) Patent No.: US 8,905,149 B2
(45) Date of Patent: Dec. 9, 2014

(54) EXPANDABLE SEAL WITH CONFORMING RIBS

(75) Inventors: William M. Bailey, Humble, TX (US); Steven R. Hayter, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 813 days.

(21) Appl. No.: 13/155,847

(22) Filed: Jun. 8, 2011

(65) Prior Publication Data

US 2012/0312559 A1 Dec. 13, 2012

(51) Int. Cl.
*E21B 33/12* (2006.01)
*E21B 43/10* (2006.01)

(52) U.S. Cl.
CPC ..... *E21B 43/106* (2013.01); *E21B 33/1208* (2013.01)
USPC ..... 166/387; 166/207

(58) Field of Classification Search
USPC ..... 166/387, 207; 277/607
See application file for complete search history.

(56) References Cited

U.S. PATENT DOCUMENTS

| | | | |
|---|---|---|---|
| 927,874 | A | 7/1909 | Robinson |
| 2,069,212 | A | 2/1937 | Buffington |
| 2,196,668 | A | 4/1940 | Ragan |
| 2,289,164 | A | 7/1942 | Arnold et al. |
| 2,330,425 | A | 9/1943 | Hilton |
| 2,464,713 | A | 3/1949 | Penick |
| 2,467,822 | A | 4/1949 | Griffin et al. |
| 2,604,946 | A | 7/1952 | Sweet |
| 2,720,267 | A | 10/1955 | Brown |
| 2,743,781 | A | 5/1956 | Lane |
| 2,789,004 | A | 4/1957 | Foster |
| 2,812,025 | A | 11/1957 | Teague et al. |
| 2,880,806 | A | 4/1959 | Davis |
| 2,970,651 | A | 2/1961 | Roberts |

(Continued)

FOREIGN PATENT DOCUMENTS

| | | | |
|---|---|---|---|
| GB | 2230800 | A | 10/1990 |
| GB | 2 406 593 | A | 4/2005 |
| WO | WO 86/02971 | | 5/1986 |
| WO | WO 95/23908 | | 9/1995 |

OTHER PUBLICATIONS

J.D. Burley, et al., Recent Developments in Packer Seal Systems for Sour Oil and Gas Wells, Oct. 9-12, 1977, pp. 1-8, SPE 6762, American Institute of Mining, Metallurgical, and Petroleum Engineers, Inc., U.S.A.

(Continued)

*Primary Examiner* — William P Neuder
(74) *Attorney, Agent, or Firm* — Greenberg Traurig, LLP

(57) ABSTRACT

Expandable seals have one or more conforming ribs to facilitate creation of a seal to a sealing surface disposed in the well. The conforming ribs comprise a core of material either capped, partially covered by, or entirely covered by a ring. The ring can be formed of a metal that is softer than the metallic core material of each rib. Suitable metals forming the rings include copper formed by metal spun methods. Disposed adjacent to the rings are one or more sealing elements. By moving the rings into the sealing surface during expansion of the expandable seals, the rings close the extrusion gaps between the internal surface of the casing and the expanded tubular member ribs. The rings better conform to the sealing surface of the casing, thereby facilitating the creation of the seal between this sealing surface and each of the sealing elements.

20 Claims, 2 Drawing Sheets

(56) References Cited

U.S. PATENT DOCUMENTS 3,036,639 A 5/1962 Baker
3,085,627 A 4/1963 Sodich
3,171,492 A 3/1965 Cochran
3,268,275 A 8/1966 Laughlin
3,364,993 A 1/1968 Skipper
3,436,084 A 4/1969 Courter
3,554,280 A 1/1971 Tucker
3,926,254 A 12/1975 Evans et al.
3,952,656 A 4/1976 Fox et al.
4,258,926 A 3/1981 Upton
4,285,400 A 8/1981 Mullins, II
4,313,495 A 2/1982 Brandell
4,441,551 A 4/1984 Biffle
4,452,463 A 6/1984 Buckner
4,458,752 A 7/1984 Brandell
4,469,172 A 9/1984 Clark
4,488,740 A 12/1984 Baugh et al.
4,573,537 A 3/1986 Hirasuna et al.
4,615,544 A 10/1986 Baugh
4,685,516 A 8/1987 Smith et al.
4,706,746 A 11/1987 White et al.
4,729,430 A 3/1988 White et al.
4,787,446 A 11/1988 Howell et al.
4,793,424 A 12/1988 Lim, Jr.
4,877,086 A 10/1989 Zunkel
4,900,067 A 2/1990 Jansen et al.
5,097,902 A 3/1992 Clark
5,193,616 A 3/1993 Hynes
5,203,412 A 4/1993 Doggett
5,207,272 A 5/1993 Pringle et al.
5,220,959 A 6/1993 Vance, Sr.
5,236,047 A 8/1993 Pringle et al.
5,257,663 A 11/1993 Pringle et al.
5,291,947 A 3/1994 Stracke
5,320,182 A 6/1994 Mendez
5,327,962 A 7/1994 Head
5,343,963 A 9/1994 Bouldin et al.
5,466,537 A 11/1995 Diede et al.
5,540,280 A 7/1996 Schultz et al.
5,542,473 A 8/1996 Pringle
5,577,560 A 11/1996 Coronado et al.
5,613,557 A 3/1997 Blount et al.
5,701,959 A 12/1997 Hushbeck et al.
5,833,001 A 11/1998 Song et al.
5,849,188 A 12/1998 Voll et al.
5,849,198 A 12/1998 Sharpless
5,936,913 A 8/1999 Gill et al.
5,975,205 A 11/1999 Carisella
6,006,835 A 12/1999 Onan et al.
6,009,951 A 1/2000 Coronado et al.
6,055,213 A 4/2000 Rubbo et al.
6,102,117 A 8/2000 Swor et al.
6,102,120 A 8/2000 Chen et al.
6,142,227 A 11/2000 Hiorth et al.
6,173,788 B1 1/2001 Lembcke et al.
6,173,969 B1 1/2001 Stoll et al.
6,203,020 B1 3/2001 Mireles, Jr. et al.
6,341,654 B1 1/2002 Wilson et al.
6,343,796 B1 2/2002 Lee et al.
6,361,049 B1 3/2002 Joco
6,390,479 B1 5/2002 Combet et al.
6,431,273 B1 8/2002 McGarian et al.
6,497,416 B1 12/2002 Morvant
6,571,876 B2 6/2003 Szarka
6,626,243 B1 9/2003 Go Boncan
6,712,153 B2 3/2004 Turley et al.
6,769,491 B2 8/2004 Zimmerman et al.
6,772,844 B2 8/2004 Lloyd et al.
6,779,601 B2 8/2004 Wilson et al.
6,798,350 B2 9/2004 Maxit et al.
6,834,725 B2 12/2004 Whanger et al.
6,843,315 B2 1/2005 Coronado et al.
6,843,480 B2 1/2005 Nelson et al.
6,854,522 B2 2/2005 Brezinski et al.
6,962,206 B2 11/2005 Hirth et al.
7,165,622 B2 1/2007 Hirth et al.
7,188,691 B2 3/2007 Yong et al.
7,204,525 B2 4/2007 Matzner
7,210,533 B2 5/2007 Starr et al.
7,213,814 B2 5/2007 Hurlbert et al.
7,228,896 B2 * 6/2007 Gazewood ..... 166/123
7,316,271 B2 * 1/2008 Moyes ..... 166/179
7,322,410 B2 1/2008 Vinegar et al.
7,331,581 B2 2/2008 Xu et al.
7,363,970 B2 4/2008 Corre et al.
7,387,165 B2 6/2008 Lopez de Cardenas et al.
7,448,445 B2 11/2008 Doane et al.
7,478,679 B2 1/2009 Berzin et al.
7,610,964 B2 11/2009 Cox
7,617,880 B2 11/2009 Loughlin
7,703,542 B2 4/2010 O'Connor et al.
7,726,407 B2 6/2010 Wood et al.
7,743,835 B2 6/2010 Willauer
7,748,468 B2 7/2010 Casciaro
7,806,177 B2 10/2010 Bishop et al.
7,806,192 B2 10/2010 Foster et al.
7,806,193 B2 10/2010 Berzin et al.
7,845,402 B2 12/2010 O'Connor et al.
7,886,818 B1 2/2011 O'Connor et al.
7,891,433 B2 2/2011 Vinson et al.
7,931,093 B2 4/2011 Foster et al.
7,938,192 B2 5/2011 Rytlewski
8,016,295 B2 9/2011 Guest et al.
8,037,942 B2 10/2011 Vinson et al.
2003/0080515 A1 5/2003 Milberger et al.
2003/0131988 A1 7/2003 Wilson et al.
2004/0112609 A1 6/2004 Whanger et al.
2004/0129432 A1 7/2004 Wills et al.
2004/0134659 A1 7/2004 Hoffman et al.
2005/0023003 A1 2/2005 Echols et al.
2005/0067170 A1 3/2005 Richard
2005/0161229 A1 7/2005 Doane et al.
2005/0199401 A1 9/2005 Patel et al.
2005/0284633 A1 12/2005 Richard
2006/0124310 A1 6/2006 Lopez de Cardenas et al.
2006/0186602 A1 8/2006 Martin et al.
2007/0039160 A1 2/2007 Turley et al.
2007/0056725 A1 3/2007 Lucas et al.
2007/0125532 A1 6/2007 Murray et al.
2007/0144734 A1 6/2007 Xu et al.
2007/0193736 A1 8/2007 Corre et al.
2007/0267824 A1 * 11/2007 Baugh et al. ..... 277/607
2007/0289749 A1 12/2007 Wood et al.
2007/0290454 A1 12/2007 Garrison et al.
2008/0087417 A1 4/2008 Doane et al.
2008/0110625 A1 5/2008 Arcement et al.
2008/0135260 A1 6/2008 Berzin et al.
2008/0149351 A1 6/2008 Marya et al.
2008/0156501 A1 7/2008 Vinson et al.
2008/0264647 A1 10/2008 Li
2008/0283236 A1 11/2008 Akers et al.
2008/0302543 A1 12/2008 O'Connor et al.
2009/0126947 A1 5/2009 King
2009/0139707 A1 6/2009 Berzin et al.
2009/0173490 A1 7/2009 Dusterhoft et al.
2009/0211767 A1 8/2009 Nutley et al.
2009/0211770 A1 8/2009 Nutley et al.
2009/0242214 A1 10/2009 Foster et al.
2009/0255675 A1 10/2009 Casciaro
2009/0255690 A1 10/2009 Conner et al.
2009/0308656 A1 12/2009 Chitwood et al.
2010/0071908 A1 3/2010 Bishop et al.
2010/0078180 A1 4/2010 O'Connor et al.
2010/0155050 A1 6/2010 Frazier
2010/0230094 A1 9/2010 Foster et al.
2010/0230902 A1 9/2010 Castillo et al.
2011/0005778 A1 1/2011 Foster et al.
2011/0036560 A1 2/2011 Vail, III et al.
2011/0036561 A1 2/2011 Bishop et al.
2011/0259587 A1 10/2011 Joseph et al.
2012/0037355 A1 2/2012 Bishop et al.
2012/0067564 A1 3/2012 Mack et al.
2012/0119445 A1 5/2012 Castillo et al.
2012/0305253 A1 12/2012 O'Malley

(56) References Cited

U.S. PATENT DOCUMENTS

OTHER PUBLICATIONS

D.D. Onan, et al., Elastomeric Composites for Use in Well Cementing Operations, Oct. 3-6, 1993, pp. 593-608, SPE 26572, Society of Petroleum Engineers, Inc., U.S.A.

Thomas W. Ray, High Pressure/High Temperature (HP/HT) Seals for Oil and Gas Production, Feb. 17-19, 1998, pp. 603-614, SPE 39573, Society of Petroleum Engineers, Inc., U.S.A.

Product Report, ZXP Compression Set Liner Packer, Sep. 2001, Baker Hughes Incorporated, Houston, Texas, USA.

Gordon MacKenzie, et al., Wellbore Isolation Intervention Devices Utilizing a Metal-to-Metal Rather Than an Elastomeric Sealing Methodology, Nov. 11-14, 2007, pp. 1-5, SPE 109791, Society of Petroleum Engineers, Inc., U.S.A.

S. Yakeley, et al., Swellable Packers for Well Fracturing and Stimulation, Nov. 11, 2007, pp. 1-7, SPE 110621, Society of Petroleum Engineers, U.S.A.

King, George E., Permanent and Retrievable Packer Removal, Mar. 14, 2009, pp. 1-35, George E. King Engineering, Inc., USA.

* cited by examiner

EXPANDABLE SEAL WITH CONFORMING RIBS

BACKGROUND

1. Field of Invention

The present invention is directed to expandable seals for use in oil and gas wells and, in particular, expandable seals having conforming ribs comprising a metallic material that is softer or more malleable as compared to the metal forming the device carrying the seals to facilitate creation of the seal to a sealing surface disposed in the well.

2. Description of Art

Tubular members having a sealing element such as a packer have been used to seal the annulus of cased wells. In one operation, after the well is drilled into the earth formation an casing is run-in the open-hole formation, a tubular member having a packer is run-in the cased well. The packer is designed to divide the well by sealing against the inner wall of the casing, thereby isolating a lower portion of the annulus from an upper portion of the annulus.

In operation, after the tubular member is run into the desired location in the well, a cone or other device can be transported through the bore of the tubular member until it reaches a portion of the tubular member having a restricted inner diameter. Disposed on the outer wall surface of the tubular member at this location is a sealing element. As the cone, or expansion device, travels downward, this portion of the tubular member is expanded by the cone. The expansion of the tubular member causes the sealing element to contact the inner wall of the casing and separate the cased well into at least two isolated regions, one above the sealing element and one below the sealing element.

SUMMARY OF INVENTION

Broadly, the invention is directed to expandable seals. In one embodiment, the expandable seal is disposed on a expandable tubular member such that as the tubular member is radially expanded, the seal contacts and seals against a sealing surface such as the inner wall surface of a cased wellbore. The expandable seals can have one or more conforming ribs disposed around an outer diameter, i.e., along an outer wall surface, of a tubular member. As used herein, the term "conforming" means that the rib, when pressed into the sealing surface of the casing, conforms to the shape of the sealing surface to which it is engaged. By conforming to the shape of the sealing surface, the a extrusion gap between sealing elements is closed off, thereby providing a better seal.

In one particular embodiment, one or more of the conforming ribs comprise a metallic core material capped, partially covered, or entirely covered by a metallic conforming material formed from a metal such as copper or other metal that is softer or more malleable than the metal forming the tubular member and, thus, softer than the core material of the rib. One or more sealing elements can be disposed either above, below, or both above and below the conforming rib to facilitate creation of the seal between the sealing surface and the tubular member.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
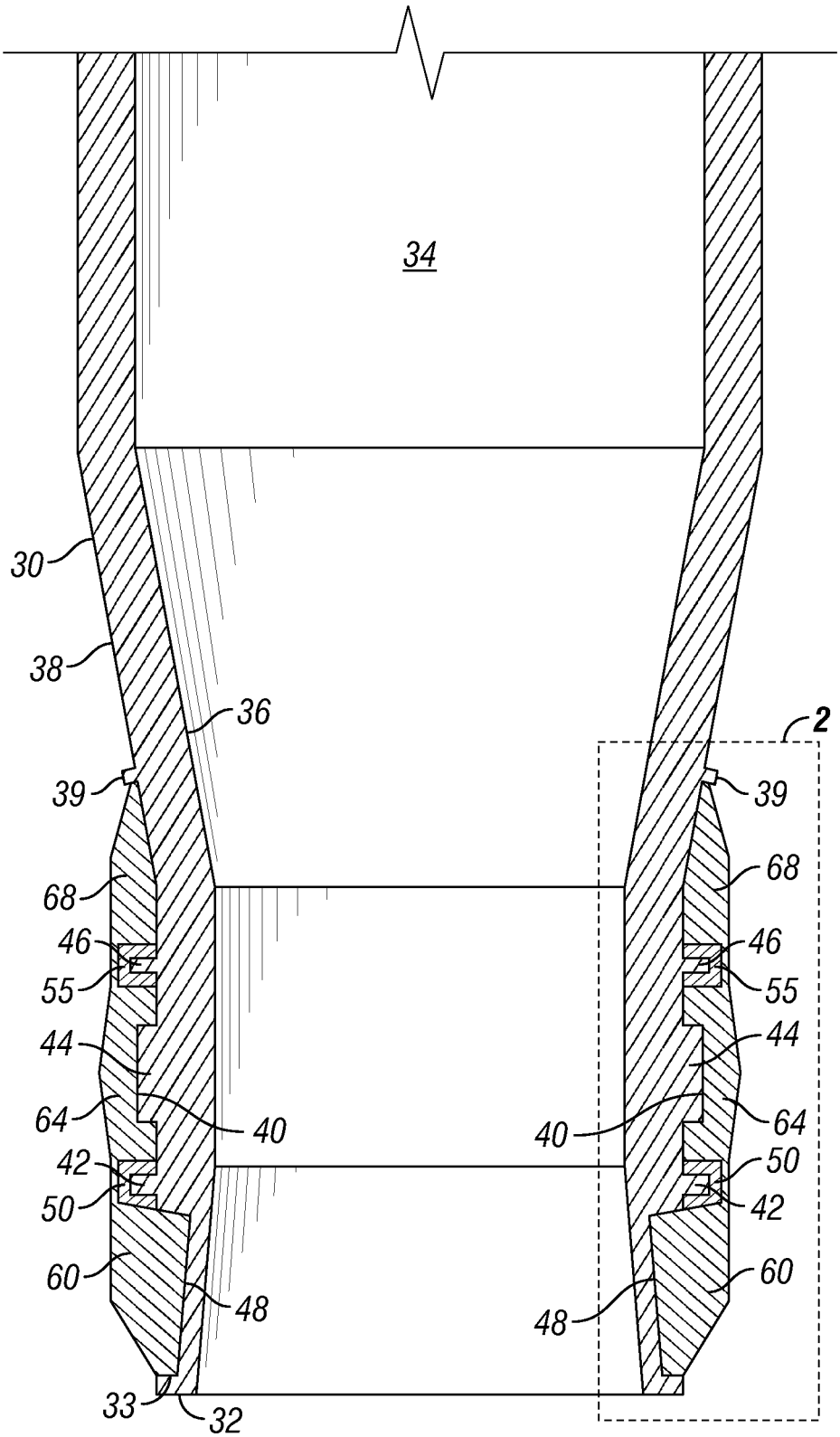
FIG. 1 is a cross-sectional view of one embodiment of an expandable tubular member having a sealing device, FIG. 1 showing the tubular member in its run-in position prior to being expanded or moved into its set or sealing position.
Figure 2:
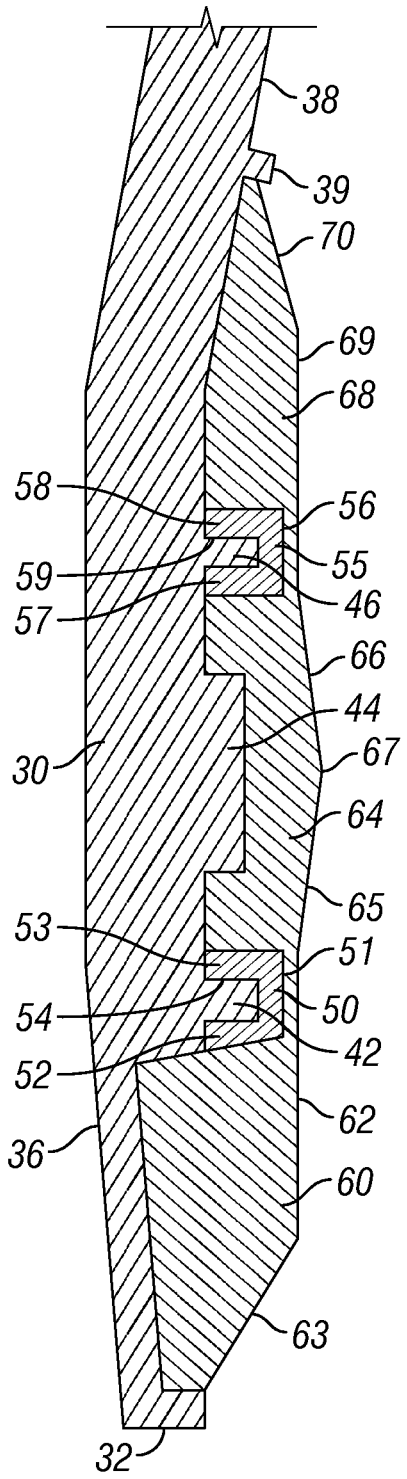
FIG. 2 is a detailed cross-sectional view of the sealing device shown in FIG. 1.

Referring now to FIGS. 1-2 in one specific embodiment, tubular member 30 comprises first end 32, bore 34 defined by inner wall surface 36, and outer wall surface 38. Outer wall surface 38 comprises profile 40. Profile 40 comprises first rib 42, second rib 44, third rib 46, and recess 48. Recess 48 is bound on one end by first end 32 which comprises shoulder 33. Disposed over first rib 42 and third rib 46 are rings 50, 55, respectively, comprising a conforming material. In one particular embodiment, the conforming materials of rings 50, 55 are metal spun wherein the metal is softer, i.e. more malleable, than the material forming tubular member 30, i.e., the core material. Because the conforming material is more malleable compared to the core material, when rings 50, 55 engage the sealing surface they conform to the shape of the sealing surface, thereby closing the extrusion gap between the sealing elements (discussed in greater detail below) and facilitating creation of the seal between the sealing elements and the sealing surface (not shown). One suitable metal for rings 50, 55 is copper where the metal forming tubular member 30 is stainless steel. Other suitable metals for rings 50, 55 include silver, gold, and alloys containing one or more of copper, silver, or gold. Other suitable metals forming tubular member 30 include low alloy steel or nickel alloy.

As shown in FIGS. 1-2, rings 50, 55, respectively, comprise outer diameter surfaces 51, 56, first sides 52, 57, and second sides 53, 58 to provide recesses 54, 59. Disposed within recesses 54, 59 are ribs 42, 46 so that ribs 42, 46 are completely covered by rings 50, 55. Although rings 50, 55 are shown as covering the entirety of first rib 42 and third rib 46, it is to be understood that rings 50, 55 are not required to be disposed over first rib 42 and third rib 46, provided the outer diameter surfaces of first rib 42 and third rib 46 are covered by rings 50, 55.

Disposed within recess 48 between shoulder 33 of first end 32 of tubular member 30 and first rib 42 (with ring 50), and bonded to outer wall surface 38, is first sealing element 60. First sealing element 60 may be bonded to outer wall surface 38 through any device or method known in the art. For example, first sealing element 60 may be bonded to outer wall surface 38 through chemical bonding. As best shown in FIG. 2, first sealing element 60 comprises outer diameter surface 62. Outer diameter surface 62 is slightly larger than outer diameter surface 51 of ring 50 so that, upon expansion of tubular member 30, ring 50 pierces sealing element 60 before engaging the inner wall surface of the wellbore casing. First sealing element 60 also comprises tapered surface to transition first sealing element 60 from outer diameter surface 62 to shoulder 33 of first end 32 of tubular member 30.

Disposed over second rib 44 between first rib 42 (with ring 50) and third rib 46 (with ring 52), and bonded to outer wall surface 38, is second sealing element 64. Second sealing element 64 may be bonded to outer wall surface 38 through any device or method known in the art. For example, second sealing element 64 may be bonded to outer wall surface 38 through chemical bonding. As shown best in FIG. 2, second sealing element 64 has tapered outer surfaces 65, 66 intersecting at apex 67. Tapered surfaces 65, 66 connect with first sealing element 60 and third sealing element 68 (discussed in greater detail below).

Disposed between third rib 46 (with ring 55) and flange 39 disposed on outer wall surface 38 of tubular member 30, and bonded to outer wall surface 38, is third sealing element 68. Third sealing element 68 may be bonded to outer wall surface 38 through any device or method known in the art. For example, third sealing element 68 may be bonded to outer wall surface 38 through chemical bonding. As best shown in FIG. 2, third sealing element 68 comprises outer diameter surface 69. Outer diameter surface 69 is slightly larger than outer diameter surface 56 of ring 55 so that, upon expansion of tubular member 30, ring 55 pierces sealing element 68 before engaging the inner wall surface of the wellbore casing. Third sealing element 68 also comprises tapered surface 70 to transition third sealing element 68 from outer diameter surface 69 toward outer wall surface 38 of tubular member 30 as tapered surface 70 approaches flange 39.

First sealing element 60, second sealing element 64, and third sealing element 68 may be formed out of any material known in the art. Suitable materials include, but are not limited to, elastomers, rubbers, polymers, or thermoplastics. In addition, none of first sealing element 60, second sealing element 64, or third sealing element 68 is required to have the shapes described with respect to the embodiments of FIGS. 1-2. To the contrary, first sealing element 60, second sealing element 64, and third sealing element 68 may have any shape desired or necessary to provide the requisite compression or deformation of first sealing element 60, second sealing element 64, and third sealing element 68 to form a seal with a sealing surface such as found on the inner wall of a wellbore.

In operation of the embodiment of FIGS. 1-2, after tubular member 30 is properly located within a wellbore (not shown), a cone (not shown) or other expanding device is run through bore 34 of tubular member 30. For example, as the cone travels downward in the Figures, i.e., downhole, tubular member 30 is forced radially outward from the longitudinal axis of tubular member 30. Alternatively, tubular member 30 can travel downward in the Figures to engage a stationary expansion device (not shown). The stationary expansion device causes first end 32 to radially expand allowing tubular member 30 to continue moving downward over the stationary expansion device. In either operation, tubular member 30 is forced radially outward causing the diameter of bore 34 to be radially expanded. As a result of the radial expansion of tubular member 30, rings 50, 55 pierce first sealing element 60 and third sealing element 68, respectively, and engage with the inner wall surface of the wellbore. Either simultaneously, or slightly before or after the engagement of rings 50, 55 with inner wall surface of the wellbore, outer diameter surface 62 of first sealing element 60, apex 67 of second sealing element 64, and outer diameter surface 69 of third sealing element 68 also engage with the inner wall surface of the wellbore. As the radial load is increased due to the passage of the cone through bore 34, rings 50, 55 are forced into the inner wall surface of the wellbore. In so doing, rings 50, 55 conform to the shape of the inner wall surface of the wellbore because rings 50, 55 are formed of a material that is more malleable than the material forming ribs 42, 46, as well as more malleable than the material forming the inner wall surface of the wellbore. As a result, rings 50, 55 close the extrusion gap between first and second sealing elements 60, 64 and the extrusion gap between second and third sealing elements 64, 68. In addition, first sealing element 60, second sealing element 64, and third sealing element 68 are forced into the inner wall surface of the casing to form a seal between the inner wall surface of the casing and sealing elements 60, 64, 68.

It is to be understood that the invention is not limited to the exact details of construction, operation, exact materials, or embodiments shown and described, as modifications and equivalents will be apparent to one skilled in the art. For example, the conforming material may completely encase or cover the ribs, or it may be disposed only on the outer surface of the ribs. Additionally, the conforming material is not required to be disposed on a rib, but instead can be disposed on the outer wall surface of the tubular member in other manners. For example, the conforming material may be an insert set into a groove cut into the outer wall surface of the tubular member. Moreover, one or more of first, second, and third sealing elements can be omitted. In addition, one or more of first, second, and third sealing elements can have shapes different than as described with respect to the embodiments of FIGS. 1-2. Further, the shape of the ribs can be modified from the shapes as shown in the embodiments of FIGS. 1-2. Further, although a cone is described as being used to expand the tubular member, it is to be understood that any device or method known to persons of ordinary skill in the art may be used to expand the tubular member. Accordingly, the invention is therefore to be limited only by the scope of the appended claims.

What is claimed is:

1. A sealing device for an expandable tubular, the sealing device comprising:

a tubular member having an outer wall surface and a bore defined by an inner wall surface;

a first rib disposed on the outer wall surface, the first rib comprising a first metallic core material providing a first rib outer diameter surface; and a first metallic conforming material disposed on at least a portion of the first rib outer diameter surface, the first metallic conforming material being more malleable compared to the first metallic core material.

2. The sealing device of claim 1, wherein the first metallic conforming material partially covers a first side of the first rib.

3. The sealing device of claim 2, wherein the first metallic conforming material completely covers the first rib.

4. The sealing device of claim 1, wherein the first metallic conforming material comprises copper.

5. The sealing device of claim 1, further comprising:

a second rib, the second rib comprising a second metallic core material providing a second rib outer diameter surface and a second metallic conforming material disposed on at least a portion of the second rib outer diameter surface, the second metallic conforming material being more malleable compared to the second metallic core material.

6. The sealing device of claim 5, wherein the second metallic conforming material partially covers a first side of the second rib.

7. The sealing device of claim 6, wherein the second metallic conforming material completely covers the second rib.

8. The sealing device of claim 5, wherein the first metallic conforming material partially covers a first side of the first rib.

9. The sealing device of claim 8, wherein the first metallic conforming material completely covers the first rib.

10. The sealing device of claim 5, wherein the first metallic conforming material completely covers the first rib and the second metallic conforming material completely covers the second rib.

11. The sealing device of claim 5, wherein the first metallic conforming material and the second metallic conforming material comprise copper.

12. An expandable tubular for disposition within a wellbore, the expandable tubular comprising:

a radially expandable body having an outer wall surface, the body comprising a metallic core material;

a first metallic conforming material disposed on the outer wall surface, the first metallic conforming material engaging a sealing surface when the body is radially expanded, the first metallic conforming material being more malleable as compared to the metallic core material.

13. The expandable tubular of claim 12, wherein the first metallic conforming material is disposed on an outer diameter surface of a first rib, the first rib being disposed on the outer wall surface of the body.

14. The expandable tubular of claim 12, wherein the first metallic conforming material forms a first ring disposed around the outer wall surface of the body.

15. The expandable tubular of claim 14, wherein the first ring is disposed over a first rib, the first rib being disposed on the outer wall surface of the body.

16. The expandable tubular of claim 15, wherein the first ring completely covers the rib.

17. The expandable tubular of claim 12, further comprising a second metallic conforming material disposed on the outer wall surface.

18. The expandable tubular of claim 17, wherein the second metallic conforming material is disposed on an outer diameter surface of a second rib, the second rib being disposed on the outer wall surface of the body.

19. A method of sealing an annulus of a wellbore, the method comprising the steps of:

(a) running a tubular member into a wellbore defined by an inner wall surface, the tubular member having an outer wall surface and a sealing device disposed on the outer wall surface, the sealing device comprising a metallic core material and a metallic conforming material, the metallic conforming material being more malleable compared to the metallic core material, the metallic conforming material being disposed over a portion of the metallic core material on an outer wall surface of the sealing device;

(b) applying a radial load to expand the tubular member causing the metallic conforming material to engage the inner wall surface of the wellbore; and (c) continuing to apply the radial load causing the metallic conforming material to change shape in conformance with the shape of the inner wall surface of the wellbore, thereby creating a seal between the inner wall surface of the wellbore and the sealing device.

20. The method of claim 19, wherein the metallic core material is disposed on a rib, the rib being disposed on the outer wall surface of the tubular member, and wherein during step (c), the rib transfers the radial load to the metallic conforming material.

* * * * *